United States Patent [19]

Shimizu

[11] 4,137,120

[45] Jan. 30, 1979

[54] BOOKBINDING MACHINE

[76] Inventor: Masaaki Shimizu, Q Flat Bldg., 31, Banshu-cho, Shinjuku-ku, Tokyo, Japan

[21] Appl. No.: 826,065

[22] Filed: Aug. 19, 1977

[30] Foreign Application Priority Data

Aug. 24, 1976 [JP] Japan ..... 51/113734[U]
Aug. 24, 1976 [JP] Japan ..... 51/113735[U]
Aug. 24, 1976 [JP] Japan ..... 51/113736[U]

[51] Int. Cl.[2] ..... B05C 1/02

[52] U.S. Cl. ..... 156/556; 118/202; 118/238; 118/243; 156/578

[58] Field of Search ..... 11/1 AD; 118/243, 263, 118/238, 202; 156/556, 578

[56] References Cited

U.S. PATENT DOCUMENTS 567,742 9/1896 Galicher ..... 118/238
2,221,998 11/1940 Powers ..... 118/243 X
2,279,994 4/1942 Jones ..... 118/263
3,604,391 9/1971 Mallia et al. ..... 118/243 X

FOREIGN PATENT DOCUMENTS 273967 6/1951 Switzerland ..... 11/1 AD

*Primary Examiner*—John McIntosh
*Attorney, Agent, or Firm*—Christensen, O'Connor, Johnson & Kindness

[57] ABSTRACT

A bookbinding machine wherein a book to be bound is positioned above a container containing a hot-melt type of adhesive, with the back of the book facing down toward the adhesive, and an adhesive applicator plate normally dipped in the adhesive and heated to an elevated temperature is raised from within the adhesive so as to apply the adhesive carried on the upper surface of the plate to the whole area of the back of the book at one and the same time. A table is provided on which a cover sheet is placed ready to be attached to the back of the book to which adhesive has been applied.

10 Claims, 10 Drawing Figures

6
49
1
9
8
14
12
11
25
13
10
3
46
35
44
1
6
43
27
4
7
5
23
13
24
22
23
26
2a
2

BOOKBINDING MACHINE

This invention relates to a bookbinding machine and, more particularly, to a machine for binding a plurality of sheets of paper or the like material to be bound into a book.

It is customary in the art of bookbinding to apply adhesive to one edge surface or back of a plurality of piled sheets of paper to be bound together (which will be referred to as a book hereinafter). A hot-melt type of adhesive has been in wide use for the purpose. This type of adhesive is made of a thermoplastic synthetic resin. When the adhesive is to be used, it is heated to about 160° to 180° C. so as to melt it to a low viscosity.

For application of such adhesive to the back of a book to be bound, a rotary drum type of applicator has been in general use. The drum applicator has the lower portion of its circumferential surface dipped in the adhesive in a container, and the book to be bound is passed over the applicator with its back in sliding contact with the upper portion of the circumferential surface of the rotating drum so as to apply adhesive to the back of the book.

Generally such adhesives have a low thermal conductivity, so that it is difficult by mere application of adhesive to the back of the book in the above manner to have the applied adhesive sufficiently penetrated into the paper with resulting insufficiency of the binding strength.

To overcome the difficulty, it has been proposed to provide a heater in the applicator drum so as to heat the back of the book to which adhesive is to be applied. However, the back of the book is contacted by the drum for only a short period of time since the drum rotates, so that it is practically difficult to heat the back of the book to a sufficiently high temperature. If the back is to be heated sufficiently, the speed at which the book is moved in sliding contact with the applicator drum must be slowed down with resulting increase in the time required for application of adhesive to the back of the book.

Accordingly, it is one object of the invention to provide a bookbinding machine which can increase the binding strength of the adhesive applied to the back of a book to be bound.

Another object of the invention is to provide such a bookbinding machine as aforesaid which is capable of heating the back of a book to a temperature sufficiently high for the purpose in a relatively short period of time.

Another object of the invention is to provide such a bookbinding machine as aforesaid which is capable of heating the whole area of the back of a book and applying adhesive to the same whole area at one and the same time.

An additional object of the invention is to provide such a bookbinding machine as aforesaid wherein a smaller space suffices for supporting a cover sheet to be applied to the back of a book to be bound.

In a preferred embodiment of the invention, adhesive is contained in a container and kept at an elevated temperature by a suitable heating device such as an electric heater. An applicator in the form of a plate is dipped in the adhesive in the container so that the whole body of the plate is heated by the same heater.

For application of adhesive to one edge surface or back of a book, the book is held stationary at a predetermined position above the adhesive container, and the applicator plate is raised out of the adhesive in the container. Since the adhesive is heated at 160° to 180° C. into melted condition having a viscosity of about 600 to 1100 cps, a considerably greater force would be required to raise the plate if it were kept horizontal or parallel with the surface of the adhesive in the container as it was raised in the adhesive.

To reduce the above force, when the applicator plate is raised, it is inclined from the horizontal position so that one lateral edge of the plate first is caused to project above the upper surface of the adhesive in the container and then the plate is raised aslant in the direction of the inclination. When the whole plate has come out of the adhesive, the lower lateral edge thereof is raised as far as needed to cause the plate assume a horizontal position and the horizontal plate is pressed onto the back surface of the book. A smaller force is required to raise the applicator plate obliquely from within the adhesive than if the plate were raised vertically as it is held horizontal.

As the applicator plate is raised from within the adhesive obliquely or in an inclined position, any excess of adhesive on the surface of the plate flows down therefrom into the container so that a proper amount of adhesive remains on the surface of the plate so as to be applied onto the back of the book.

When the applicator plate with a suitable amount of adhesive thereon is brought into contact with the back of the book, the adhesive is applied to the whole area of the back at one time, so that the binding strength is increased and the application of adhesive is finished in a shorter time than if adhesive is applied to the back of the book from one end of the longitudinal extension of the back to the opposite end thereof.

After the application of adhesive has been completed, the applicator plate is moved in a manner opposite to that in which it was raised from within the adhesive in the container, so that the plate is dipped into the adhesive obliquely or in its inclined position. This prevents the applicator plate from bringing air with it into the adhesive and/or splashing it.

Since a relatively small force is required for raising the applicator plate from within the adhesive in the above manner, the force to transport a book from where it is clamped to above the adhesive container may be used to raise the applicator plate out of the adhesive.

Prior to application of adhesive, a book to be bound is held standing on one edge surface or back thereof on a setting table. The table can selectively be set to a horizontal position and an inclined position. A cover sheet folded in two is placed on the table set to its inclined position in such a manner that the cover sheet sandwiches the table. Then the table is restored to its horizontal position and a book to be bound is arranged with its back on the table and clamped. The book is then moved to a position above the adhesive container and the applicator plate is raised from in the adhesive to apply a suitable amount of adhesive to the back of the book, which is then returned to the original position above the table, which applies the cover sheet to the back of the book. Then the table is again set to the inclined position and the book with the cover sheet now adhered thereto is pulled upward obliquely in the direction of inclination of the table so as to be taken out of the machine.

The cover sheet is folded in two when it is placed on the table, so that a smaller area suffices for supporting the cover sheet than if the cover sheet is placed on the table as it is kept unfolded.

The invention will be described in detail with reference to the accompanying drawings, wherein the same reference numerals in different figures denote corresponding parts, and wherein.

Referring in detail to the drawings, there is shown a machine frame having a pair of side walls 1, between which a setting table 2 and a container 3 containing a hot melt type of adhesive are provided.

Figure 1:
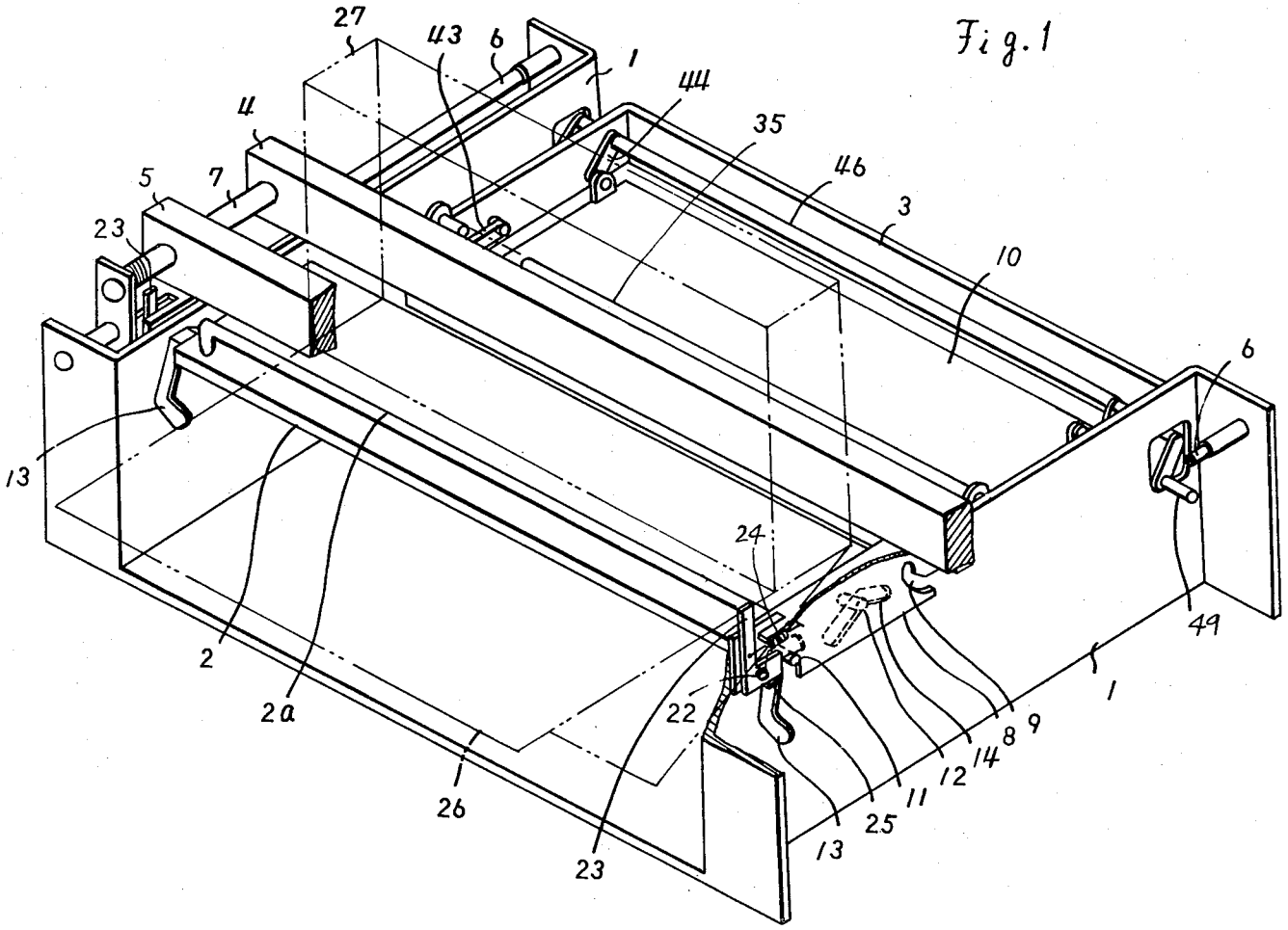
FIG. 1 is a perspective view, partly cut away, of a bookbinding machine embodying the invention.

A pair of clamping members 4 and 5 extend between the pair of side walls. The clamping member 4 has its opposite ends fixed to a pair of dog plates 8 arranged outside the side walls. The dog plates are movable along a pair of guide rods 6. The clamping member 5 is movable toward and away from the clamping member 4 along a pair of guide rods 7, only one of which is shown in FIG. 1.

The clamping member 5 is movable along the rods 7 relative to the clamping member 4 and can be fixed by a suitable known device at any desired position along the rods so as to clamp a book between the members 4 and 5 as will be described later. The clamping member 5 is connected to the dog plates 8 through the guide rods 7 and the clamping member 4.

Each dog plate 8 is formed with a slot 9, the function of which is to raise an adhesive applicator plate 10 in the container 3 so as to apply the surface of the applicator plate 10 onto the back of a book clamped between the clamping members for application of adhesive thereto, as will be described later in detail.

Figure 4:
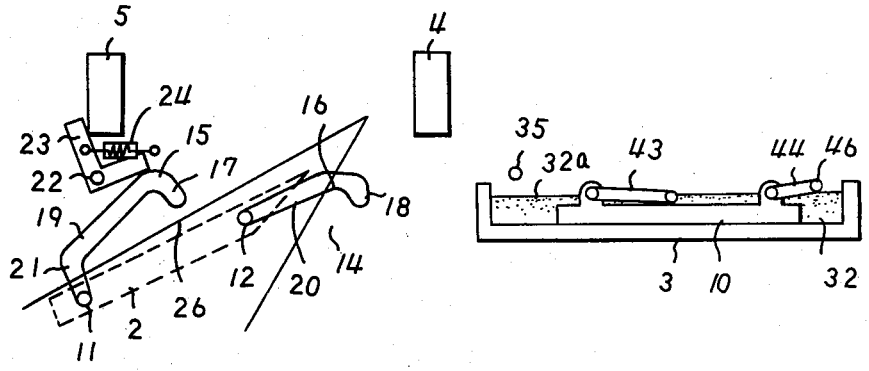

The setting table 2 is provided at each of the opposite edges thereof with a pair of horizontally outwardly projecting pins 11 and 12, which slidably engage in a pair of slots 13 and 14, respectively, formed in each of the two side walls 1. As shown in FIG. 4, the slots 13 and 14 comprise a horizontal portion 15, 16, a rear inclined portion 17, 18 extending rearwardly (toward the container 3) and a front inclined portion 19, 20 extending forwardly and downwardly from the horizontal portion.

A vertical portion 21 is formed extending from the front inclined portion 19 of the slot 13. The vertical slot portion 21 may be omitted, but it is useful to increase the angle of inclination of the setting table 2 as will be described later.

The front inclined slot portion 19 is longer and has a greater angle of inclination than the front inclined slot portion 20. An L-shaped lever 23 is pivoted at 22 to each dog plate 8 at the front end thereof and is biased clockwise in FIG. 1 by a coil spring 24. A stopper 25 prevents clockwise rotation of the lever 23 beyond a predetermined angle. The pin 11 is normally held or clamped between one end of the L-shaped lever 23 and a lateral abutment edge 8*a* formed on the dog plate 8.

Normally, the pins 11 and 12 of the table 2 are positioned in the horizontal slot portions 15 and 16 so that the table is held horizontal, with the pin 11 being held between the end of the lever 23 and the edge 8*a* of the plate 8 so as to secure the horizontal position of the table.

Prior to the binding operation, a cover sheet 26 is placed on the table 2. The cover sheet is folded in two, with its inner surface appearing exteriorly and one of the two portions of the folded cover sheet being longer by the thickness of the book to be bound than the other portion.

The clamping member 5 is moved forwardly away from the clamping member 4 along the guide rods 7 as far as the member 5 pushes the lever 23 to pivot it counterclockwise in FIG. 1 against the force of the spring 24 thereby releasing the clamp on the pin 11, so that the pins 11 and 12 are freely movable in the slots 13 and 14.

Then, the table 2 is inclined from its horizontal position, with the pins 11 and 12 being guided along the front inclined slot portions 19 and 20. The pin 11 is farther guided into the vertical slot portion 21 to increase the forward inclination of the table 2, as shown in FIG. 4. A handle 2*a* is provided to make easier the above operation for inclination and restoration of the table.

Under the condition of FIG. 4 the table 2 has its front (or left-hand) portion lowered and the folded cover sheet 26 is placed on the table 2 from the rear (right-hand) side thereof so that the folded cover sheet sandwiches the table as shown in FIG. 4. The inclined position of the table makes this operation easier than otherwise.

Figure 5:
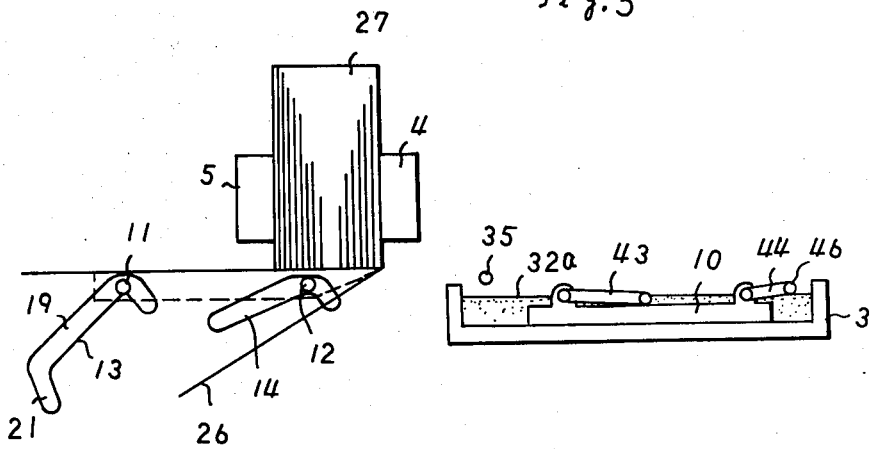

After the cover sheet has been properly positioned on the table 2, the table is returned to the horizontal position. Then a plurality of piled sheets of paper or book to be bound is brought onto the table so that one edge surface or back of the book contacts the table, and the clamping member 5 is moved toward to the clamping member 4 to clamp the book between the two members as shown in FIG. 5.

The container 3 contains a suitable hot-melt adhesive 32. A pair of heater plates 3' are provided in the container. The heater heats the adhesive at a temperature of about 160° to 180° C. so that it is melted to have a viscosity of 1100 to 600 cps.

An adhesive applicator 10 in the form of a plate is normally dipped in the adhesive 32 in the container 3 so that the upper surface of the plate is submerged below the surface of the adhesive and so that the bottom surface of the applicator plate 10 is in contact with the bottom wall of the container and is heated by the heaters 3'. The heaters may be provided in any other suitable manner, such as for example, embedded in the bottom wall of the container.

Figure 2:
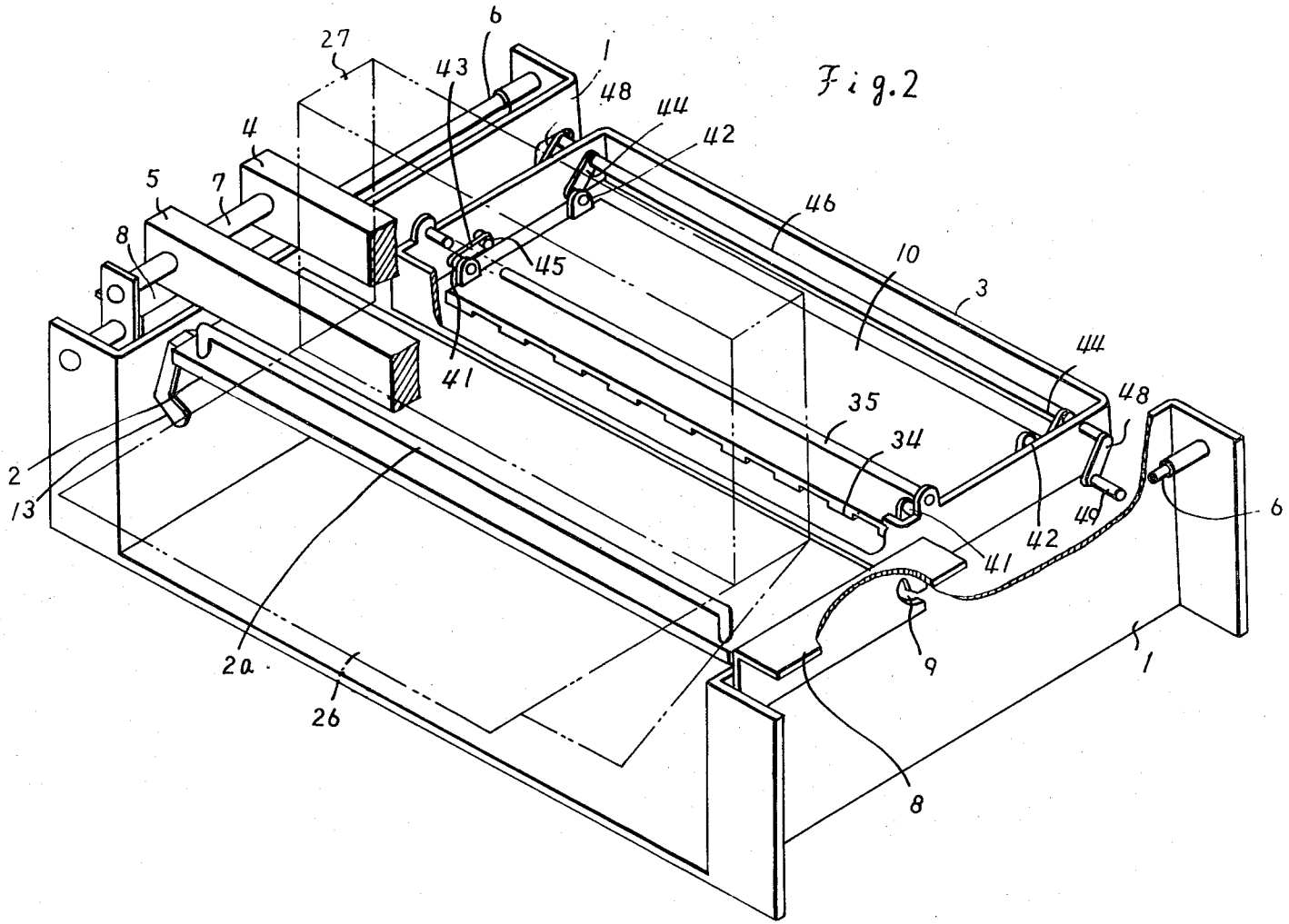
FIG. 2 is a view similar to FIG. 1, but with more portions thereof cut away than in FIG. 1.

In practice, as shown in FIG. 2 a plurality of projections 34 may advantageously be formed on the under surface of the applicator plate 10 and/or the upper surface of the bottom wall of the container 3 so as to prevent close contact of the whole areas of the two surfaces, thereby to enable easier raising of the plate 10 than otherwise.

The applicator 10 is provided at each of the opposite ends thereof with a pair of horizontally extending pins 41 and 42, to which levers 43 and 44 are pivoted, respectively. Each lever 43 is longer than the lever 44 and has its opposite end pivoted by a pin 45 to one of the opposite side walls of the container 3.

Each of the other levers 44 has its opposite end fixed to a shaft 46 extending between and rotatably supported by the opposite side walls of the container 3.

A lever 48 has its one end fixed to each of the opposite end portions of the shaft 46 projecting outwardly through the side walls of the container 3 and the side walls 1 of the machine frame. A handle 49 is fixed to the opposite end of each of the levers 48 so as to be in alignment with the axis of the pin 42.

The previously mentioned slot 9 formed in the dog plate 8 comprises an inlet portion 50 open at one lateral edge of the plate 8, an inclined portion 51 extending upwardly therefrom and a vertical portion 52 extending farther upwardly therefrom.

Figure 6:
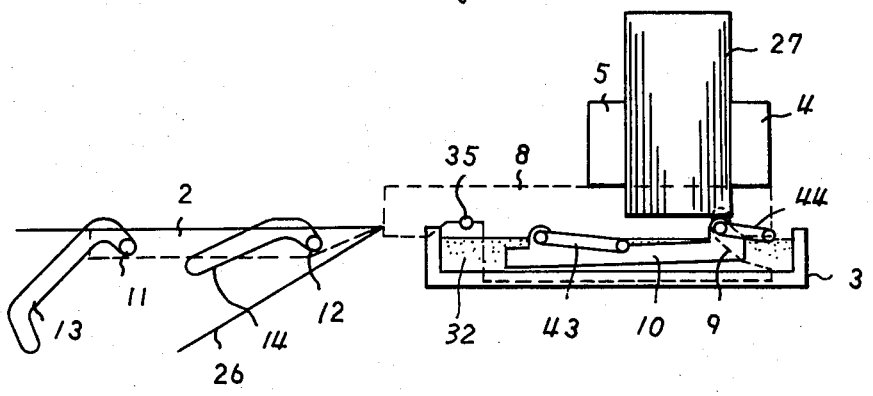

As previously mentioned, the clamping member 5 is moved toward the clamping memeber 4 to clamp a book therebetween (FIG. 5) and the two clamping members are fastened by a suitable means not shown. The clamping members with the book therebetween are moved rightward so as to be positioned above the container 3. This movement is accompanied by that of the dog plate 8 toward the right. In the course of movement the handle 49 is engaged by and enters the inlet portion 50 of the slot 9. As the handle advances farther into the inclined portion 51 of the slot, it is gradually raised, that is, rotated clockwise about the axis of the shaft 46. Since the handle 49, the lever 48 and the shaft 46 form a single integral member, the rotation of the handle 49 causes rotation of the pin 42 about the axis of the shaft 46 for the same angle of rotation of the handle 49. As a result, the right-hand side of the applicator plate 10 is raised as shown in FIG. 6. As the handle 49 moves farther into the vertical slot portion 52, the whole of the plate 10 is farther raised upwardly aslant toward the right because the length of the lever 44 remains unchanged, with the lever 43 and consequently the pin 41 being rotated clockwise about the pin 45, so that the left-hand side of the applicator plate 10 is raised to bring the plate 10 to a horizontal position above the upper surface 32*a* of the adhesive 32. At this raised horizontal position, the upper surface of the plate 10 is pressed against the downwardly facing back of the book as shwon in FIG. 7.

Figure 3:
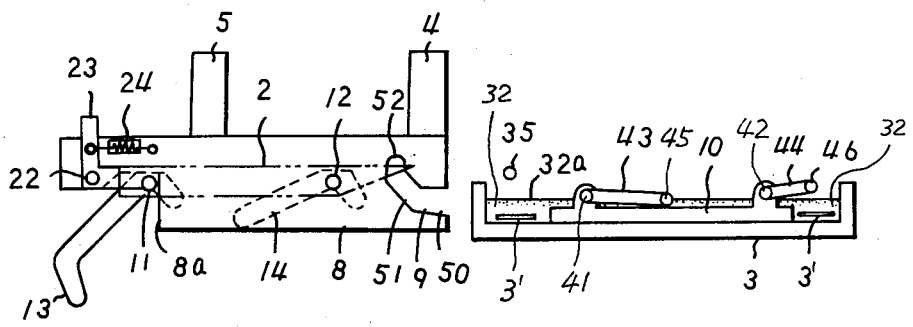
FIGS. 3 to 10 are schematic side views for explanation of the operation of the machine of the invention.

There is a certain amount of adhesive on the upper surface of the plate 10 that has been raised in the above manner and the plate 10 was heated in the container to an elevated temperature, so that when the plate is brought into contact with the back of the book in the above manner, the back is heated. In other words, adhesive is applied to the back of the book as the back is being heated, so that the adhesive penetrates sufficiently into the back of the book. The time during which the plate is kept in contact with the back is about 10 seconds. Upon lapse of the time, the clamping members are returned to the original position, so that the plate is moved in the manner opposite to that in which the plate is raised so as to sink into the bottom of the container 3 as shown in FIG. 3.

A scraper rod 35 may be provided so as to scrape excess adhesive off the back of the book as the latter is returned to the original position.

Figure 7:
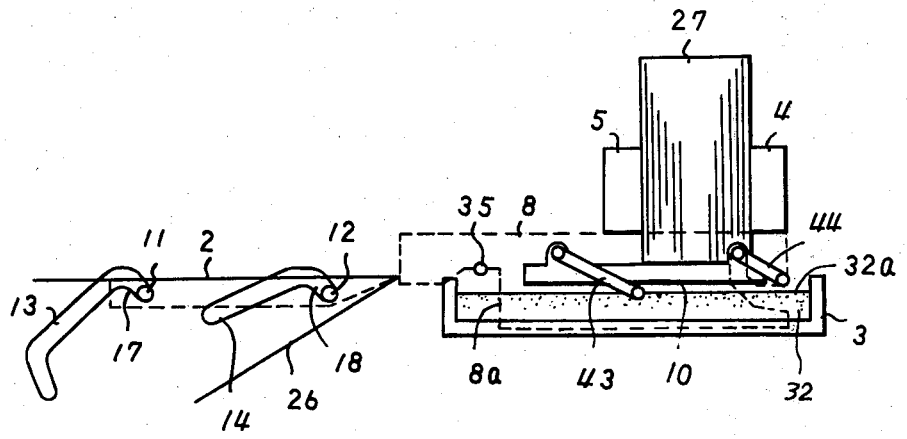
Figure 8:
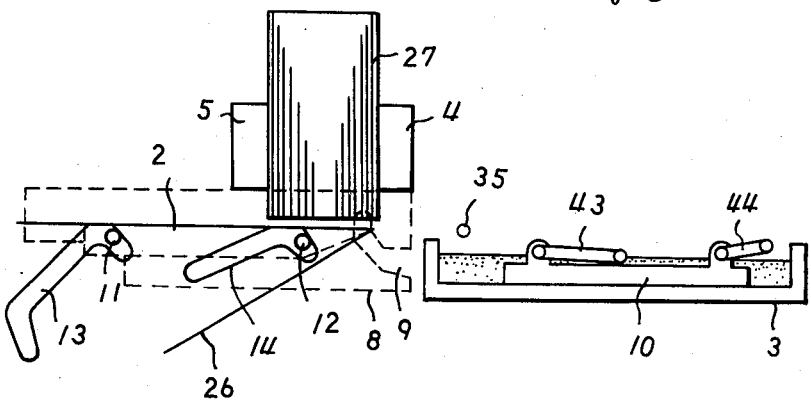

The setting table 2 may advantageously be so arranged that it is a little lowered after the book has been clamped between the bars 4 and 5 so as to prevent the adhesive on the back of the book from being attached onto the table when the book has been returned to the original position above the table. To this end when the clamping members 4 and 5 with the book clamped therebetween are initially moved from above the table toward the container, the levers 23 push the pins 11 fixed to the opposite ends of the table into the rear inclined portions 17 of the slots 13. This causes the pins 12 to simultaneously move into the rear inclined portions 18 of the slots 14, so that the table is a little lowered as it is kept horizontal (FIGS. 6 and 7).

Figure 9:
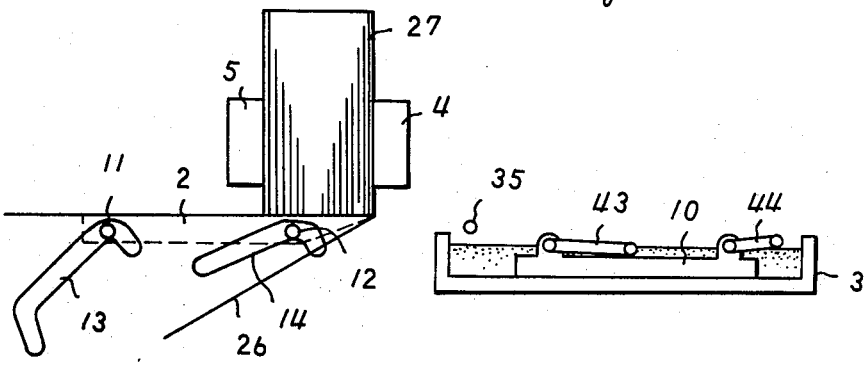

When the book is returned to the original position after a sufficient amount of adhesive has been applied to the back of the book, the lateral edge 8*a* of the dog plate 8 pushes the pin 11 back to the horizontal portion 15 of the slot 13, simultaneously causing the pin 12 to be positioned in the horizontal portion 16 of the slot 14, so that the table 2 is raised to the horizontal position thereby to press the cover sheet thereon onto the back of the book to be adhered thereto as shown in FIG. 9.

Figure 10:
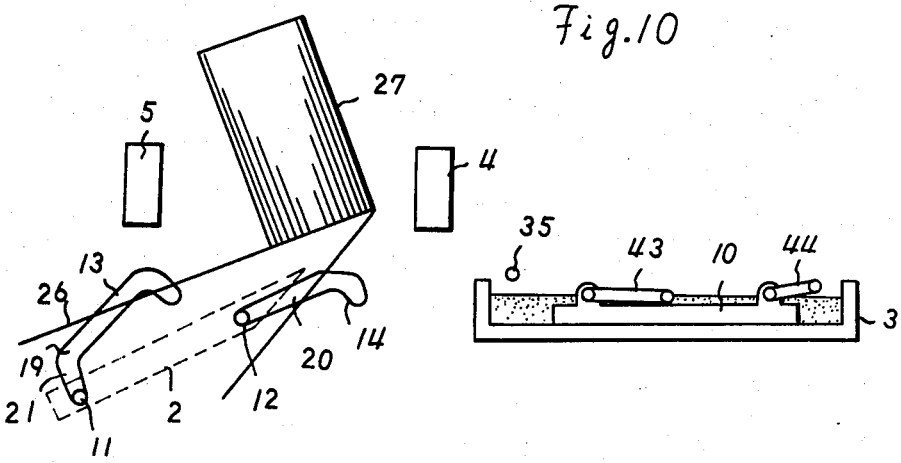

Then, the clamping member 5 is moved away from the book, and the table is inclined by leading the pins 11 and 12 into the front inclined slot portions 19 and 20 of the slots 13 and 14, respectively, and the pin 11 farther into the vertical portion 21 of the slot 13. Then the book is taken out together with the cover sheet now adhered to the back of the book (FIG. 10).

The table is then returned to the horizontal position, thereby completing one cycle of the binding operation.

What I claimed is:

1. A bookbinding machine comprising: a container for containing a hot melt type of adhesive therein; an adhesive applicator plate having a heat retaining body for being disposed in said container; means for heating said adhesive and said applicator plate while in said container; means for clamping a book comprising a plurality of piled sheets of paper or the like to be bound together above said container so that the back of said book is disposed in a horizontal plane and faces the upper surface of said adhesive; and applicator plate positioning means for selectively positioning said applicator plate at a first position submerged in said adhesive and at a second position raised out of said adhesive and in contact with the back of said book clamped by said clamping means to apply adhesive to said back while concurrently heating it with heat retained by the body of said applicator plate, and wherein said applicator plate positioning means includes means for raising said plate obliquely from said position submerged within said adhesive to the upper surface of said adhesive and then bringing said plate to a horizontal position as said plate is moved to said second position.

2. The bookbinding machine of claim 1, further including means for selectively positioning said clamping means at a first position above said container and at a second position laterally away from said first position, and wherein said applicator plate positioning means operates in response to said clamping means positioning means so that when said positioning means moves said clamping means from said second to said first position, said applicator plate positioning means operates to move said applicator plate from said first to said second position, while when said clamping means positioning means moves said clamping means from said first to said second position, said applicator plate positioning means operates to move said applicator plate from said second to said first position.

3. The bookbinding machine of claim 2, further including a setting table disposed below said second position of said clamping means, means for selectively placing said table at an inclined position wherein a cover sheet folded in two is put on said table and at a horizontal position wherein said cover sheet is in contact with said back of said book.

4. The bookbinding machine of claim 3, further including means for lowering said table when said clamping means is moved to position said book at said first position above said container and raising said table when said clamping means is moved to position said book to whose back adhesive has been applied at said second position above said table so that said cover sheet is brought into contact with said back of said book.

5. The bookbinding machine of claim 3, wherein said placing means comprises means for defining a first and a second slot at each of the opposite sides of said table, a first and a second pin provided at each of the opposite side edges of said table so as to slidably engage in said first and second slots, respectively, each of said slots comprising a horizontal portion and a front inclined portion extending from said horizontal portion downwardly obliquely.

6. The bookbinding machine of claim 5, wherein said first slot further includes a vertical portion extending downwardly from said front oblique portion.

7. The bookbinding machine of claim 5, wherein each of said first and second slots further includes a rear inclined portion extending downwardly obliquely from said horizontal portion, so that positioning of said first and second pins into and out of said respective rear inclined slot portions causes raising and lowering of said table.

8. The bookbinding machine of claim 1, wherein said applicator plate positioning means comprises a first and a second pin fixed at each of the opposite longitudinal ends of said plate, a first lever having its one end pivotally connected to said first pin and its opposite end pivoted at a predetermined position, a second lever having its one end pivotally connected to said second pin and its opposite end fixed to a rotatable shaft, a handle fixed to each of the opposite ends of said shaft, a pair of movable dog plates each provided with a slot with which said handle is engageable, said each slot comprising a horizontal portion open at one lateral edge of each said dog plate, an oblique portion extending from said horizontal portion and a vertical portion extending from said oblique portion.

9. The bookbinding machine of claim 8, wherein said dog plates are attached to said clamping means so as to be movable therewith.

10. The bookbinding machine of claim 1, wherein said applicator plate has an upper surface for contacting the back of said book and has a lower surface, and said container has a bottom wall spaced beneath the surface of said adhesive, and wherein said means for heating is disposed so as to apply heat to said bottom wall of said container, and said applicator plate positioning means includes means for disposing said applicator plate with its lower surface in contact with said bottom wall of said container when said applicator plate is disposed in said first position whereby said applicator plate is heated by said heating means through said bottom wall of said container.

* * * * *